United States Patent [19]

Hara et al.

[11] Patent Number: 4,923,648

[45] Date of Patent: May 8, 1990

[54] PROCESS FOR THE PRODUCTION OF PITCH-TYPE CARBON FIBERS

[75] Inventors: Ryuichi Hara, Machida; Masami Kagizaki; Tsuyoshi Takakura, both of Kitakyushu; Shigeki Tomono, Kawasaki, all of Japan

[73] Assignee: Mitsubishi Kasei Corporation, Tokyo, Japan

[21] Appl. No.: 245,564

[22] Filed: Sep. 19, 1988

Related U.S. Application Data

[60] Division of Ser. No. 39,679, Apr. 20, 1987, which is a continuation-in-part of Ser. No. 748,441, Jun. 21, 1985, abandoned.

[30] Foreign Application Priority Data

| | | | |
|---|---|---|---|
| Jun. 26, 1984 | [JP] | Japan | 59-131641 |
| Feb. 7, 1985 | [JP] | Japan | 60-22570 |
| May 7, 1985 | [JP] | Japan | 60-96194 |
| May 8, 1985 | [JP] | Japan | 60-96973 |
| May 8, 1985 | [JP] | Japan | 60-96974 |
| May 8, 1985 | [JP] | Japan | 60-96975 |

[51] Int. Cl.[5] ..... D01F 9/12

[52] U.S. Cl. ..... 264/29.2; 264/211.11; 425/461

[58] Field of Search ..... 264/29.2, 169, 83, 176.1, 264/211.11, 211.14, 211.17; 425/198, 461, 467

[56] References Cited

U.S. PATENT DOCUMENTS

| | | | |
|---|---|---|---|
| 3,104,419 | 9/1963 | La Forge | 425/198 |
| 3,475,527 | 10/1969 | Chapman | 425/198 |
| 3,506,753 | 4/1970 | Flamand | 425/198 |
| 3,781,399 | 12/1973 | Kobayashi et al. | 264/171 |
| 3,847,524 | 11/1974 | Mott | 425/198 |
| 4,376,747 | 3/1983 | Nazem et al. | 264/29.2 |
| 4,511,625 | 4/1985 | Nazem et al. | 264/29.2 |

FOREIGN PATENT DOCUMENTS

| | | |
|---|---|---|
| 49-8634 | 2/1974 | Japan . |
| 49-19127 | 2/1974 | Japan . |
| 54-160427 | 12/1979 | Japan . |
| 57-100186 | 6/1982 | Japan . |
| 58-18421 | 2/1983 | Japan . |
| 5096975 | 1/1986 | Japan . |

*Primary Examiner*—Hubert C. Lorin

*Attorney, Agent, or Firm*—Oblon, Spivak, McClelland, Maier & Neustadt

[57] ABSTRACT

A carbon fiber having a cross-sectional structure of regular mesh form orientation as observed by a polarizing microscope is produced by a method comprising melt spinning pitch material through spinning nozzles, followed by infusible treatment and carbonization, wherein a mesh filter layer is provided at an upstream portion of each nozzle, and the pitch material is passed first through the mesh filter layer and then through the nozzle for spinning.

8 Claims, 3 Drawing Sheets

PROCESS FOR THE PRODUCTION OF PITCH-TYPE CARBON FIBERS

This is a division of application Ser. No. 39,679, filed Apr. 20, 1987 which is continuation-in-part of U.S. patent application Ser. No. 748,441 filed June 21, 1985, now abandoned.

BACKGROUND OF THE INVENTION

1. Field of the Invention

The present invention relates to a carbon fiber having a novel cross-sectional structure and improved strength.

2. Discussion of Background

Carbon fibers have high specific strength and high specific modulus, and they are expected to be most prospective as filler fibers for high performance composite materials. Among them, pitch-type carbon fibers have various advantages over polyacrylonitrile-type carbon fibers in that the raw material is abundantly available, the yield in the carbonization step is high, and the elastic modulus of fibers is high.

Various studies have been made for the preparation of pitch material having good orientation properties for spinning, since it has been reported that it is possible to obtain pitch-type carbon fibers having high quality by using a pitch wherein carbonaceous raw material is heat-treated to develop anisotropy and readily orientable molecular seeds are formed, instead of an isotropic pitch which has been commonly used as the pitch material for spinning (Japanese Examined Patent Publication No. 8634/1974).

It is well known that when a carbonaceous raw material such as heavy oil, tar or pitch is heated at a temperature of from 350° to 500° C., there form, in the material, small spherical particles which have a particle size of from a few microns to a few hundred microns and which exhibit an optical anisotropy under polarized light. When further heated, these small spherical particles grow and are integrated to form a structure having an optical anisotropy. This anisotropic structure is considered to be a precursor for a graphite crystal structure, wherein planar polymeric aromatic hydrocarbon layers formed by the thermal polycondensation of the carbonaceous raw material are laminated and oriented.

A heat-treated product including such an anisotropic structure is generally called mesophase pitch.

As a method for using such mesophase pitch as the pitch material for spinning, there has been proposed a method wherein e.g. petroleum pitch is subjected to heat treatment at a temperature of from about 350° to about 450° C. under a stand-still condition to obtain a pitch containing from 40 to 90% by weight of a mesophase, which is used as the pitch material for spinning (Japanese Unexamined Patent Publication No. 19127/1974). However, it takes a long period of time to convert an isotropic carbonaceous raw material to the mesophase pitch by such a method. Under the circumstances, there has been proposed a method wherein the carbonaceous raw material is preliminarily treated with a sufficient amount of a solvent to obtain an insoluble component, which is then subjected to heat treatment at a temperature of from 230° to 400° C. for a short period of time, i.e. for 10 minutes or less, to form a so-called neomesophase pitch which is highly oriented and contains at least 75% by weight of the optical anisotropic component and at most 25% by weight of quinoline-insoluble components, and the neomesophase pitch is used as the pitch material for spinning (Japanese Unexamined Patent Publication No. 160427/1979).

As other pitch materials having good orientation properties for the production of high performance carbon fibers, there have been proposed a so-called premesophase pitch, i.e. a pitch which is obtainable by subjecting e.g. coal tar pitch to hydrogenation treatment in the presence of tetrahydroquinoline, followed by heat treatment at a temperature of about 450° C. for a short period of time and which is optically isotropic and capable of being changed to have an optical anisotropy when heated at a temperature of at least 600° C. (Japanese Unexamined Patent Publication No. 18421/1983), or a so-called dormant mesophase, i.e. a pitch which is obtainable by subjecting a mesophase pitch to hydrogenation treatment e.g. by the Birch reduction method and which is optically isotropic and, when an external force is applied, exhibits an orientation to the direction of the external force (Japanese Unexamined Patent Publication No. 100186/1982).

It is possible to obtain pitch fibers by melt spinning such pitch material having good orientation properties through spinning nozzles. Then, the pitch fibers may be subjected to infusible treatment and carbonization, and optionally to graphitization, to obtain pitch-type high performance carbon fibers.

When the above-mentioned pitch material having good orientation properties is melt-spun, the laminar structure of planar polymeric hydrocarbon in the resulting pitch fibers is likely to have radial orientation in the cross-section of each fiber. Carbon fibers are commonly used for various fiber-reinforced composites, of which matrices are made of e.g., an epoxy resin, a phenol resin or aluminum. In such cases, not only the strength of carbon fibers but also the bonding properties of carbon fibers with the matrix are important. As mentioned above, the carbon fibers having radial orientation in their cross-section generally have good bonding properties with the matrix, and they are preferable in such as aspect. In such pitch fibers, however, there have been drawbacks such that when tensile stress is exerted in the circumferential direction of the cross-section of each fiber due to the carbonization shrinkage during the subsequent infusible treatment and carbonization treatment, wedge-shaped cracks extending in the axial direction of each fiber are likely to form in the cross-section of the resulting carbon fiber, whereby the strength of the fiber tends to deteriorate. In an extreme case, the commercial value of the carbon fibers is impaired.

Conventional commercially available pitch-type carbon fibers have radial orientation or random orientation in their cross-sectional structure. Thus, they are weak against compression in a radial direction, although they are strong in a longitudinal direction. Accordingly, when they are used for a composite, the mechanical strength of the composite tends to be poor. As a reason for this, it is believed that since structural units in the cross-section of such commercially available carbon fibers are coarse, they are likely to cleave along such structures when a radial force is exerted to them.

SUMMARY OF THE INVENTION

The present inventors have conducted extensive researches to solve the above difficulties, and have found that carbon fibers having a cross-sectional structure of regular mesh form orientation as observed by a polarizing microscope are free from such drawbacks.

The present invention provides a carbon fiber having a cross-sectional structure of regular mesh form orientation as observed by a polarizing microscope.

DETAILED DESCRIPTION OF THE PREFERRED EMBODIMENTS

Figure 1:
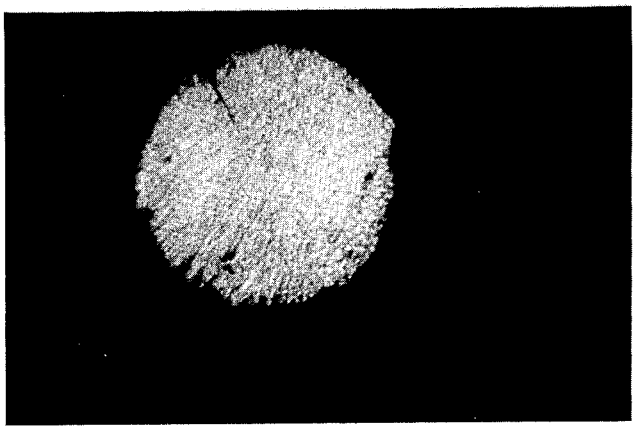
FIG. 1 is a photograph of the cross-section of a carbon fiber of the present invention as taken by a polarizing microscope (about 4,000 magnifications).

There is no particular restriction as to the pitch material for the carbon fiber of the present invention, so long as it gives an optically anisotropic carbon fiber wherein readily orientable molecular seeds are formed. Various conventional pitch materials as mentioned above may be employed.

As the carbonaceous raw material to obtain such pitch material, there may be mentioned, for instance, coal-originated coal tar, coal tar pitch or liquefied coal, or petroleum-originated heavy oil, tar or pitch. These carbonaceous raw materials usually contain impurities such as free carbon, non-dissolved coal or ash contents. It is desired that these impurities are preliminarily removed by a conventional method such as filtration, centrifugal separation or sedimentation separation by means of a solvent.

Further, the above-mentioned carbonaceous raw material may be pre-treated by a method wherein it is subjected to heat treatment, and then soluble components are extracted with a certain solvent, or by a method wherein it is subjected to hydrogenation treatment in the presence of a hydrogen-donative solvent and hydrogen gas.

In the present invention, the above-mentioned carbonaceous raw material or pre-treated carbonaceous raw material is heat treated usually at a temperature of from 350° to 500° C., preferably from 380° to 450° C. for from 2 minutes to 50 hours, preferably from 5 minutes to 5 hours in an inert gas atmosphere such as nitrogen or argon or while introducing such an inert gas, to obtain a pitch containing at least 40% by weight, particularly more than 70% by weight of an optically anisotropic structure, which is suitable for use as the mesophase pitch.

The proportion of the optically anisotropic structure of the mesophase pitch in the present invention is a value obtained as the proportion of the surface area of the portion exhibiting an optical anisotropy in the mesophase pitch, as observed by a polarizing microscope at normal temperature.

Specifically, for instance, a pitch sample is crushed into particles having a size of a few millimeter, and the sample particles are embedded on the almost entire surface of a resin having a diameter of about 2 cm in accordance with a conventional method, and the surface was polished and then the entire surface was thoroughly observed by a polarizing microscope (100 magnifications), and the ratio of the surface area of the optically anisotropic portion to the entire surface area of the sample is obtained.

For the determination of the compression strength, two carbon fiber monofilaments were arranged in parallel with each other with a distance of 2 mm from each other, a small glass sheet was placed thereon, and a compressive load was put progressively thereon, whereby a load P at which a breaking sound due to acoustic emission was detected, was obtained.

The compression strength $\sigma$ t is calculated in accordance with the following formula:

$$\sigma t = 2P/\pi DL$$

where D is the diameter of the monofilament, and L is the length of the small glass sheet.

The carbon fibers of the present invention are obtainable by a method wherein the above-mentioned pitch material for spinning is passed through a mesh filter layer, and then supplied to spinning nozzles for spinning (Japanese Patent Application No. 96975/1985).

Here, the mesh filter layer is provided at an upstream portion of each spinning nozzle, in the flow passageway of the pitch material. When the molten pitch material passes through the mesh filter layer, the flow of the pitch material is finely divided, and the laminar state of the mesophase of the pitch material is regularly divided during the passage through the mesh filter layer, whereby pitch fibers having a cross-sectional structure of regular and fine mesh form orientation as observed by a polarizing microscope, as shown in FIGS. 1 and 2, will be formed.

Figure 2:
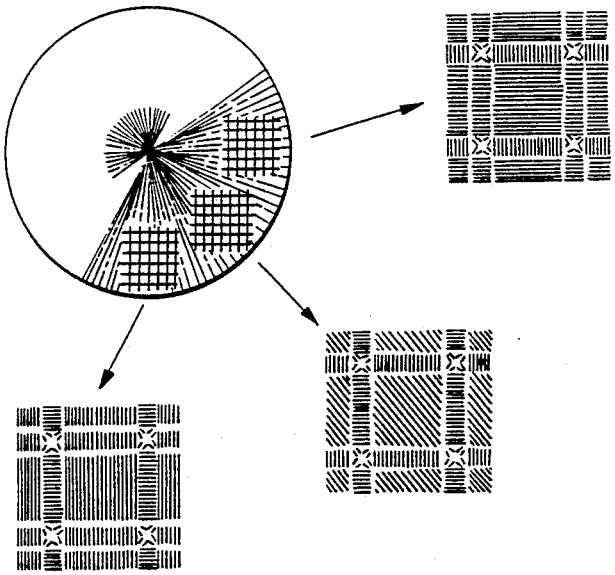
FIG. 2 is a diagrammatic illustration of the same cross-section.
Figure 3:
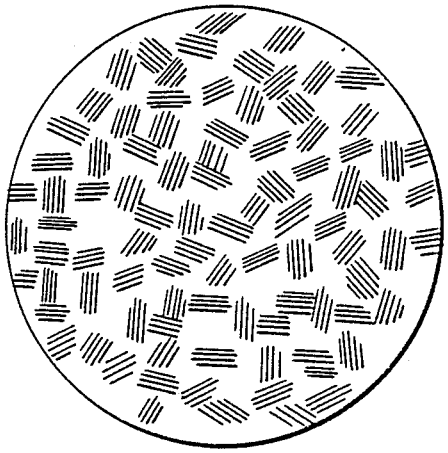
FIGURE 3 PRIOR ART
FIG. 3 is a diagramatic illustration of the cross-section of a conventional carbon fiber which has a cross-sectional crystal structure of random orientation.

In the accompanying drawings, FIG. 1 is a photograph of the cross-section of a carbon fiber of the present invention as taken by a polarizing microscope (about 4,000 magnifications). FIG. 2 is a diagramatic illustration of the same cross-section. FIG. 3 is a diagramatic illustration of the cross-section of a conventional carbon fiber which has a cross-sectional crystal structure of random orientation. As in evident from the drawings, the carbon fiber of the present invention has a cross-sectional crystal structure, which is different from the conventional random structure.

Namely, in the present invention, the cross-sectional crystal structure has substantially uniform mesh form orientation. Here, the mesh form means a structure as shown in FIG. 1 or 2. It is desirable that the mesh form orientation is regular. The mesh size is at most 1 $\mu$m, preferably from 0.1 to 1 $\mu$m. In other words, it is desirable that the cross-section of a monofilament is substantially uniformly divided into at least 100 sections, preferably from 100 to 7,000 sections. As a mesh screen constituting the mesh filter layer, there may be mentioned a net made of a metal material such as stainless steel, copper or aluminum, or a net made of an inorganic material such as ceramics, glass or graphite, which is sufficiently durable at a temperature of from 350° to 400° C.

It is preferred to employ a net obtained by weaving fine fibers of the above- mentioned metal or inorganic material by plain weave, twill weave or tatami weave. However, it is also possible to employ a net obtained by punching out a flat metal plate to form numerous perforations, or a net like an expanded metal obtained by expanding a metal plate provided with a number of slits.

If the openings of the net are too large, the effects for finely dividing the cross-sectional structure of the fibers to avoid the radial orientation, tend to diminish. Therefore, the smaller the mesh openings, the better. Specifically, it is usual to employ a net having openings smaller than 50 mesh, preferably smaller than 100 mesh, more preferably smaller than 200 mesh. Such a net may be used in a single sheet. It is also possible to use a plurality of nets in a laminated state. However, it is preferred that the mesh filter layer has a thickness of at most 2 mm.

FIGS. 4 to 8 show enlarged views of the portions in the vicinity of the spinning nozzles in various embodiments in which the mesh filter layers of the present invention are provided. Reference numeral 1 designates a spinneret, numeral 2 designates a spinning nozzle, numeral 3 designates a supply hole, numeral 4 designates a mesh filter layer, and numeral 5 designates a space.

As shown in these Figures, the mesh filter layer 4 is located above the spinning nozzle. If the pitch material passed through the mesh filter layer 4 is maintained in the molten state for a long period of time, the finely divided flow units of the pitch material are likely to be integrated again to return to the original state prior to the passage through the mesh filter layer 4. Accordingly, it is preferably to locate the mesh filter layer above the nozzle with interposition of the space 5 therebetween so that the time required for the pitch material passed through the mesh filter layer 4 to reach the spinning nozzle is as short as possible i.e. not longer than one minute, preferably not longer than 30 seconds, more preferably not longer than 10 seconds.

The time required for the pitch material passed through the mesh filter layer 4 to reach the spinning nozzle, is represented by a volume obtained by dividing the volume from the lower side of the mesh filter layer 4 to the upper end of the inlet of the spinning nozzle i.e. the internal volume of the space 5, by the discharge amount of pitch material.

Various shapes may be employed for the space 5, as shown in FIGS. 4 to 8. However, it is preferred to adjust the angle $\theta$ from the space 5 to the inlet of the spinning nozzle 2 to be at least 90°, preferably at least 120°, whereby the effects for finely dividing the cross-sectional structure of the resulting fibers to avoid the radial orientation, can be increased. The joint portion of the space 5 and the inlet of the spinning nozzle 2 may be curved so that the angle $\theta$ will not be less than 90° C.

There is no particular restriction as to the spinning nozzles to be used in the present invention. For example, spinning nozzles having a nozzle hole diameter of from 0.05 to 0.5 mm and a length of from 0.01 to 5 mm, may be used.

The spinning nozzle means a fine hole through which the pitch material passes through immediately prior to being spun and which determines the fiber diameter, and the nozzle hole diameter means the diameter of the fine hole discharging the pitch material.

Nozzles to be used in the present invention may be of a straight tubular type or of a type wherein the center portion of the nozzle is expanded, or of a type wherein the lower portion of the nozzle is expanded, which satisfies the above conditions.

The pitch material passes through the mesh filter layer 4 and is discharged from the spinning nozzle 2 to be spun. By providing the mesh filter layer 4, it is possible to conduct the spinning while exerting a pressure of at least 0.5 kg/cm$^2$G, preferably at least 2 kg/cm$^2$G to the pitch material, at the time of discharging the pitch material.

In the present invention, when the pitch material in a molten state passes through the mesh filter layer 4, the flow of the pitch material is finely divided and the laminar state of the mesophase is regularly divided by the mesh filter layer 4, whereby pitch fibers having a cross-sectional fiber structure of regular and mesh form orientation as observed by a polarizing microscope can be obtained.

Accordingly, the flowability of the pitch material can be improved by the mesh filter layer 4, and at the same time, the formation of gas or bubbles generated from the pitch material at the spinning temperature can be suppressed by the pressurizing operation within the above-mentioned range during the spinning, whereby the stability for spinning is improved, and pitch fibers having improved properties can be produced constantly for a long period of time as uniform fibers having no size deviation among the nozzle holes.

The obtained pitch fibers are then subjected to infusible treatment and carbonization, and optionally graphitization, whereby high performance pitch-type carbon fibers having a regular and fine orientation structure with substantially uniform fine domains, free from wedge-shaped cracks extending in the axial direction of the fibers, are obtainable.

These cross-sectional fiber structures are as measured by a polarizing microscope.

The compression strength in a radial direction of these fibers is several times higher than that of commercially available pitch-type carbon fibers or pitch-type carbon fibers having a random structure. The reason for this is believed to be such that domain sizes are not uniform in a usual random structure, and axially extending voids are likely to form where large domains are present, whereby the compression strength of the fibers deteriorates.

Now, the present invention will be described in further detail with reference to Examples. However, it should be understood that the present invention is by no means restricted by these specific Examples.

EXAMPLES 1 to 3

Into a 5 liter autoclave, 2 kg of coal tar pitch and 2 kg of a hydrogenated aromatic oil were introduced and heat-treated at 450° C. for 1 hour. The treated product was distilled under reduced pressure to obtain residual pitch. Then, 200 g of this residual pitch was subjected to heat treatment at 430° C. for 125 minutes while bubbling nitrogen gas. The mesophase pitch thereby obtained had an optical anisotropy of 100%.

Figure 4:
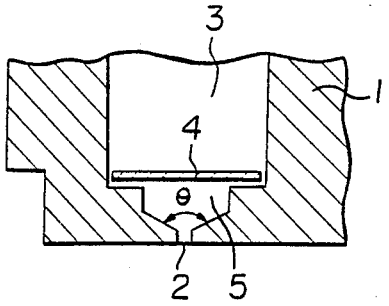
FIGS. 4 to 8 are enlarged cross-sectional diagramatic representations of various spinnerets to be used in the present invention.

Then, by using a spinneret as shown in FIG. 4, a stainless steel metal net (i.e. a network layer) 4 having the size as identified in Table 1 was provided in each supply hole 3 thereof. The position of the metal net was adjusted so that the time required for the pitch material passed through the mesh filter layer 4 to reach the spinning nozzle 2, i.e. the retention time in the space 5, was as shown in Table 1.

Then, by using this spinneret, the above-mentioned mesophase pitch was melt-spun within a temperature range of from 325° to 360° C. In each case, pitch fibers having a diameter as small as 7 $\mu$m were obtained constantly over a long period of time by adjusting the winding up speed at the optimum temperature.

Pitch fibers obtained by melt spinning at a temperature of 336° C., were subjected to infusible treatment in air at 310° C., and then carbonization treatment in an argon atmosphere at 1400° C., to obtain carbon fibers.

The tensile strength and the cross-sectional structure of the carbon fibers were measured. The results are shown in Table 1.

With respect to the fibers in Examples 1 and 2, the compression strength of the respective monofilaments was measured. The results are shown in Table 2.

EXAMPLE 4

Figure 5:
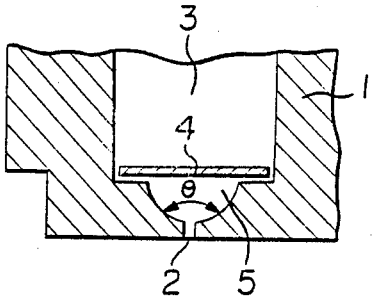

The melt spinning and carbonization treatment were conducted in the same manner as in Example 1 except that by using a spinneret as shown in FIG. 5 (i.e. a spinning nozzle 2 having a diameter of 0.2 mm and a length of 0.1 mm), a 200 mesh stainless steel metal net was provided as a mesh filter layer 4 in each supply hole 3 thereof, at a position where the retention time of pitch material in the space 5 was 3.8 seconds. In the spinning, pitch fibers having a diameter as small as 7 μm were obtained constantly over a long period of time. The results thereby obtained are shown in Table 1.

EXAMPLE 5

Figure 6:
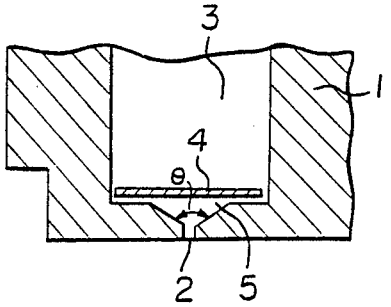
Figure 7:
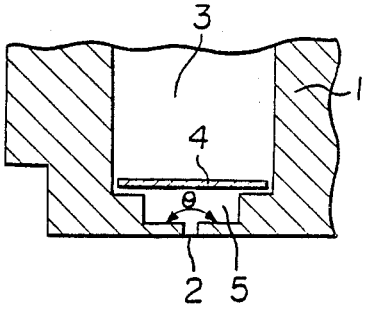
Figure 8:
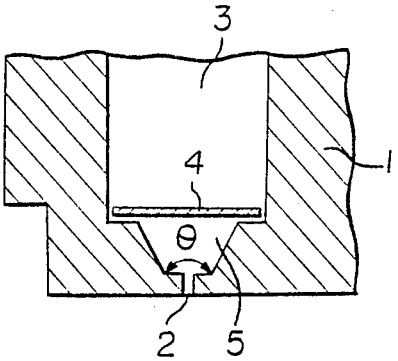

The melt spinning and carbonization treatment were conducted in the same manner as in Example 1 except that by using a spinneret as shown in FIG. 6 (i.e. a spinning nozzle 2 having a diameter of 0.1 mm and a length of 0.1 mm), a 635 mesh stainless steel metal net was provided as a network layer 4 in each supply hole 3 thereof, at a position where the retention time of pitch material at the space 5 was 0.2 second. In the spinning, pitch fibers having a diameter as small as 7 μm were obtained constantly over a long period of time. The results thereby obtained are shown in Table 1.

COMPARATIVE EXAMPLE 1

The melt spinning was conducted in the same manner as in Example 1 except that no mesh filter layer was employed, whereby pitch fibers having a diameter of 7 μm or less could not be obtained constantly. The physical values of the carbon fibers obtained in the same manner as in Example 1 are shown in Table 1.

COMPARATIVE EXAMPLE 2

Spinning was conducted in the same manner as in Example 1 except that a coralliform metal powder of stainless steel sieved to have a particle size within a range of from 60 to 65 mesh (from 0.208 to 0.246 mm) was filled in a thickness of about 10 mm in a supply hole without using a mesh filter layer. Pitch fibers having a diameter of up to 10 μm could constantly be obtained. The physical property values of the carbon fibers are shown in Table 2. As shown in the Table, they were inferior in both the tensile strength and the compression strength.

COMPARATIVE EXAMPLE 3

The physical property values of commercially available pitch-type carbon fibers are shown in Table 2. They had a radial structure, and showed poor physical properties as shown in the Table.

TABLE 1

| | Spinneret | | | | | Spinning temperature range within which pitch fibers of 7 μm can be obtained constantly (°C.) | Tensile strength of carbon fibers having a diameter of 9 μm (kg/mm²) | Cross sectional structure of carbon fibers |
|---|---|---|---|---|---|---|---|---|
| | Spinning nozzle | | Space | | Network opening size (mesh) | | | |
| | Nozzle hole diameter (mm) | Length (mm) | Retention time (sec.) | Angle θ (degree) | | | | |
| Example 1 | 0.1 | 0.05 | 4.0 | 150 | 500 | 25.0 | 356 | Mesh form structure (630) |
| Example 2 | 0.2 | 0.4 | 4.0 | 180 | 500 | 15.8 | 331 | Mesh form structure (630) |
| Example 3 | 0.2 | 0.4 | 4.0 | 150 | 200 | 14.2 | 323 | Mesh form structure (100) |
| Example 4 | 0.2 | 0.1 | 3.8 | 180 | 200 | 5.5 | 312 | Mesh form structure (100) |
| Example 5 | 0.1 | 0.1 | 0.2 | 180 | 635 | 27.4 | 374 | Mesh form structure (1100) |
| Comparative Example 1 | 0.1 | 0.05 | — | 150 | — | — | — | Entirely radial structure; cracks were observed |

The numeral in parenthesis indicates the number of sections in the cross-section of the fiber.

TABLE 2

| | Spinning temperature range within which pitch fibers of 7 μm can be obtained constantly (°C.) | Tensile strength of carbon fibers having a diameter of 9 μm (kg/mm²) | Compression strength of carbon fibers having a diameter of 9 μm (kg/mm²) | Cross sectional structure of carbon fibers |
|---|---|---|---|---|
| Example 1 | 25.0 | 356 | 16.1 | Mesh form structure (630) |
| Example 2 | 15.8 | 331 | 16.7 | Mesh form structure (630) |
| Comparative Example 1 | 15.0 | 298 | 3.4 | Random structure |

TABLE 2-continued

| | Spinning temperature range within which pitch fibers of 7 μm can be obtained constantly (°C.) | Tensile strength of carbon fibers having a diameter of 9 μm ($kg/mm^2$) | Compression strength of carbon fibers having a diameter of 9 μm ($kg/mm^2$) | Cross sectional structure of carbon fibers |
|---|---|---|---|---|
| Comparative Example 2 | — | 239* | 3.4 | Radial structure |

The numeral in parenthesis indicates the number of sections in the cross-section of the fiber.
*The diameter of carbons fibers was 10.5 μm.

What is claimed is:

1. A process for producing carbon fibers having a cross-sectional crystal structure of substantially uniform mesh form orientation as observed by a polarizing microscope, which comprises melt spinning pitch material through spinning nozzles, followed by infusible treatment and carbonization, wherein a mesh filter layer is provided at an upstream portion of each nozzle, and the pitch material is passed first through the mesh filter layer and then through the nozzle for spinning.

2. The process according to claim 1, wherein the pitch material is a pitch having an optical anisotropy of at least 40%.

3. The process according to claim 1, wherein the mesh filter layer is composed of a net made of metal or inorganic material.

4. The process according to claim 1, wherein the time required for the pitch material to pass through the mesh filter layer to reach the nozzle is not longer than 1 minute.

5. The process according to claim 1, wherein the time required for the pitch material to pass through the mesh filter layer to reach the nozzle is not longer than 30 seconds.

6. The process according to claim 1, wherein the mesh filter layer is a net of less than 50 mesh made of metal or inorganic material.

7. The process according to claim 1, wherein the pitch material is melt-spun under a pressure of at least 0.5 $kg/cm^2G$.

8. The process according to claim 1, wherein the infusible treatment and carbonization are followed by graphitization.

* * * * *